US008109349B2

(12) United States Patent
Hall et al.

(10) Patent No.: US 8,109,349 B2
(45) Date of Patent: Feb. 7, 2012

(54) THICK POINTED SUPERHARD MATERIAL

(75) Inventors: David R. Hall, Provo, UT (US); Ronald B. Crockett, Payson, UT (US); John D. Bailey, Spanish Fork, UT (US); Jeff Jepson, Spanish Fork, UT (US); Scott Dahlgren, Alpine, UT (US)

(73) Assignee: Schlumberger Technology Corporation, Houston, TX (US)

( * ) Notice: Subject to any disclaimer, the term of this patent is extended or adjusted under 35 U.S.C. 154(b) by 198 days.

(21) Appl. No.: 11/673,634

(22) Filed: Feb. 12, 2007

(65) Prior Publication Data

US 2009/0051211 A1 Feb. 26, 2009

Related U.S. Application Data

(63) Continuation-in-part of application No. 11/668,254, filed on Jan. 29, 2007, now Pat. No. 7,353,893, which is a continuation-in-part of application No. 11/553,338, filed on Oct. 26, 2006, now Pat. No. 7,665,552.

(51) Int. Cl.
*E21B 10/36* (2006.01)

(52) U.S. Cl. ..... 175/425; 175/434

(58) Field of Classification Search ..... 175/425, 175/434, 435; 299/110, 111, 113
See application file for complete search history.

(56) References Cited

U.S. PATENT DOCUMENTS

| | | | |
|---|---|---|---|
| 2,004,315 | A | 6/1935 | Fean |
| 2,124,438 | A | 7/1936 | Struk |
| 3,254,392 | A | 6/1966 | Novkov |
| 3,746,396 | A | 7/1973 | Radd |
| 3,807,804 | A | 4/1974 | Kniff |
| 3,830,321 | A | 8/1974 | McKenry |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,156,329 | A | 5/1979 | Daniels |
| 4,199,035 | A | 4/1980 | Thompson |
| 4,201,421 | A | 5/1980 | Den Besten |
| 4,277,106 | A | 7/1981 | Sahley |

(Continued)

FOREIGN PATENT DOCUMENTS

| | | |
|---|---|---|
| DE | 3500261 | 7/1986 |

(Continued)

OTHER PUBLICATIONS

International search report for PCT/US2007/075670 dated Nov. 17, 2008.

*Primary Examiner* — Brad Harcourt

(74) *Attorney, Agent, or Firm* — Brinks Hofer Gilson & Lione

(57) ABSTRACT

In one aspect of the invention, a high impact resistant tool includes a superhard material bonded to a cemented metal carbide substrate at a non-planar interface. The superhard material has a substantially pointed geometry with a sharp apex having a radius of curvature of 0.050 to 0.125 inches. The superhard material also has a thickness of 0.100 to 0.500 inches thickness from the apex to a central region of the cemented metal carbide substrate.

21 Claims, 14 Drawing Sheets

U.S. PATENT DOCUMENTS 4,333,902 A 6/1982 Hara
4,333,986 A 6/1982 Tsuji
4,412,980 A 11/1983 Tsuji
4,425,315 A 1/1984 Tsuji
4,439,250 A 3/1984 Acharya
4,465,221 A 8/1984 Schmidt
4,484,644 A 11/1984 Cook
4,489,986 A 12/1984 Dziak
4,636,253 A 1/1987 Nakai
4,647,111 A 3/1987 Bronder
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
4,956,238 A 9/1990 Griffin
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,662,720 A 9/1997 O'Tighearnaigh
5,738,698 A 4/1998 Kapoor
5,823,632 A 10/1998 Burkett
5,837,071 A 11/1998 Anderson
5,845,547 A 12/1998 Sollami
5,848,657 A 12/1998 Flood
5,875,862 A 3/1999 Jurewicz
5,890,552 A 4/1999 Scott
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,000,483 A 12/1999 Jurewicz
6,003,623 A * 12/1999 Miess ..... 175/430
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,068,913 A 5/2000 Cho
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,220,375 B1 4/2001 Butcher
6,257,673 B1 7/2001 Markham
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,460,637 B1 10/2002 Siracki
6,478,383 B1 11/2002 Ojanen
6,499,547 B2 12/2002 Scott
6,508,318 B1 1/2003 Linden
6,517,902 B2 2/2003 Drake
6,585,326 B2 7/2003 Sollami
6,596,225 B1 7/2003 Pope
6,601,662 B2 8/2003 Matthias
6,672,406 B2 * 1/2004 Beuershausen ..... 175/57
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki et al.
6,966,611 B1 11/2005 Sollami
6,994,404 B1 2/2006 Sollami
7,048,081 B2 * 5/2006 Smith et al. ..... 175/434
7,204,560 B2 4/2007 Mercier
2001/0004946 A1 6/2001 Jensen
2002/0175555 A1 11/2002 Mercier
2003/0140350 A1 7/2003 Watkins et al.
2003/0209366 A1 11/2003 McAlvain
2003/0217869 A1 * 11/2003 Snyder et al. ..... 175/428
2003/0234280 A1 12/2003 Cadden
2004/0026983 A1 2/2004 McAlvain
2004/0065484 A1 4/2004 McAlvain
2004/0256442 A1 12/2004 Gates, Jr.
2005/0044800 A1 3/2005 Hall et al.
2005/0159840 A1 7/2005 Lin
2005/0173966 A1 8/2005 Mouthaan
2006/0162969 A1 * 7/2006 Belnap et al. ..... 175/433
2006/0237236 A1 10/2006 Sreshta
2007/0193782 A1 8/2007 Fang

FOREIGN PATENT DOCUMENTS

DE 3818213 11/1989
DE 4039217 6/1992
DE 19821147 11/1999
DE 10163717 5/2003
EP 0295151 6/1988
EP 0412287 7/1990
EP 0412287 2/1991
GB 2004315 3/1979
GB 2037223 11/1979
GB 2037223 7/1980
JP 5280273 10/1993
JP 3123193 1/2001

* cited by examiner 210b
202b
203b
110c
201b
206
107c
109c
204
203a
250
251
210a
202a
107b
152
201a
110b
215
150
209a
205
214
109a
207
200

210c
109d
201c
110d
202c
107a

5/14
107e
109e
450
210d
200d
110e
451

107f
202e
109f
210e
201e
110f 107g
109g
650
210f
200f
209f
110g 107h
109h
750
210g
200g
209g
110h 107i
202h
850
210h
109i 107j
950
109j
210i 107k
109k
1050
1051
210j
201j
110k 1120
107b
1115
1102
210k
1101
1100
1103
1105
1110
109L
215k
110L

THICK POINTED SUPERHARD MATERIAL

CROSS REFERENCE TO RELATED APPLICATIONS

This application is a continuation-in-part of U.S. patent application Ser. No. 11/668,254 filed on Jan. 29, 2007 and entitled A Tool with a Large Volume of a Superhard Material, which issued as U.S. Pat. No. 7,353,893. U.S. patent application Ser. No. 11/668,254 is a continuation-in-part of U.S. patent application Ser. No. 11/553,338 filed on Oct. 26, 2006 and was entitled Superhard Insert with an Interface, which issued as U.S. Pat. No. 7,665,552. Both of these applications are herein incorporated by reference for all that they contain and are currently pending.

FIELD

The invention relates to a high impact resistant tool that may be used in machinery such as crushers, picks, grinding mills, roller cone bits, rotary fixed cutter bits, earth boring bits, percussion bits or impact bits, and drag bits. More particularly, the invention relates to inserts comprised of a carbide substrate with a non-planar interface and an abrasion resistant layer of superhard material affixed thereto using a high pressure high temperature press apparatus.

BACKGROUND OF THE INVENTION

Cutting elements and inserts for use in machinery such as crushers, picks, grinding mills, roller cone bits, rotary fixed cutter bits, earth boring bits, percussion bits or impact bits, and drag bits typically comprise a superhard material layer or layers formed under high temperature and pressure conditions, usually in a press apparatus designed to create such conditions, cemented to a carbide substrate containing a metal binder or catalyst such as cobalt. The substrate is often softer than the superhard material to which it is bound. Some examples of superhard materials that high pressure-high temperature (HPHT) presses may produce and sinter include cemented ceramics, diamond, polycrystalline diamond, and cubic boron nitride. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the high pressure high temperature press apparatus. The substrates and adjacent diamond crystal layers are then compressed under HPHT conditions, which promotes a sintering of the diamond grains to form a polycrystalline diamond structure. As a result, the diamond grains become mutually bonded to form a diamond layer over the substrate interface. The diamond layer is also bonded to the substrate interface.

Such inserts are often subjected to intense forces, torques, vibration, high temperatures and temperature differentials during operation. As a result, stresses within the structure may begin to form. Drill bits, for example, may exhibit stresses aggravated by drilling anomalies during well boring operations, such as bit whirl or bounce. These stresses often result in spalling, delamination, or fracture of the superhard abrasive layer or the substrate, thereby reducing or eliminating the cutting elements' efficacy and the life of the drill bit. The superhard material layer of an insert sometimes delaminates from the carbide substrate after the sintering process as well as during percussive and abrasive use. Damage typically found in percussive and drag drill bits may be a result of shear failure, although non-shear modes of failure are not uncommon. The interface between the superhard material layer and substrate is particularly susceptible to non-shear failure modes due to inherent residual stresses.

U.S. Pat. No. 5,544,713 by Dennis, which is herein incorporated by reference for all that it contains, discloses a cutting element which has a metal carbide stud having a conic tip formed with a reduced diameter hemispherical outer tip end portion of said metal carbide stud. The tip is shaped as a cone and is rounded at the tip portion. This rounded portion has a diameter which is 35-60% of the diameter of the insert.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al., which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material is disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary drill bit for rock drilling comprising a plurality of cutting elements held by and interference-fit within recesses in the crown of the drill bit. Each cutting element comprises an elongated pin with a thin layer of polycrystalline diamond bonded to the free end of the pin.

US Patent Application Serial No. 2001/0004946 by Jensen, although now abandoned, is herein incorporated by reference for all that it discloses. Jensen teaches a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

In one aspect of the invention, a high impact resistant tool has a superhard material bonded to a cemented metal carbide substrate at a non-planar interface. At the interface, the substrate has a tapered surface starting from a cylindrical rim of the substrate and ending at an elevated flatted central region formed in the substrate. The superhard material has a pointed geometry with a sharp apex having 0.050 to 0.125 inch radius of curvature. The superhard material also has a 0.100 to 0.500 inch thickness from the apex to the flatted central region of the substrate. In other embodiments, the substrate may have a non-planar interface. The interface may comprise a slight convex geometry or a portion of the substrate may be slightly concave at the interface.

The substantially pointed geometry may comprise a side which forms a 35 to 55 degree angle with a central axis of the tool. The angle may be substantially 45 degrees. The substantially pointed geometry may comprise a convex and/or a concave side. In some embodiments, the radius may be 0.090 to 0.110 inches. Also in some embodiments, the thickness from the apex to the non-planar interface may be 0.125 to 0.275 inches.

The substrate may be bonded to an end of a carbide segment. The carbide segment may be brazed or press fit to a steel body. The substrate may comprise a 1 to 40 percent concentration of cobalt by weight. A tapered surface of the substrate may be concave and/or convex. The taper may incorporate nodules, grooves, dimples, protrusions, reverse dimples, or combinations thereof. In some embodiments, the substrate has a central flatted region with a diameter of 0.125 to 0.250 inches.

The superhard material and the substrate may comprise a total thickness of 0.200 to 0.700 inches from the apex to a base of the substrate. In some embodiments, the total thickness may be up to 2 inches. The superhard material may comprise diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 percent by weight, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. A volume of the superhard material may be 75 to 150 percent of a volume of the carbide substrate. In some embodiments, the volume of diamond may be up to twice as much as the volume of the carbide substrate. The superhard material may be polished. The superhard material may be a polycrystalline superhard material with an average grain size of 1 to 100 microns. The superhard material may comprise a concentration of binding agents of 1 to 40 percent by weight. The tool of the present invention comprises the characteristic of withstanding impacts greater than 80 joules.

The high impact tool may be incorporated in drill bits, percussion drill bits, roller cone bits, shear bits, milling machines, indenters, mining picks, asphalt picks, cone crushers, vertical impact mills, hammer mills, jaw crushers, asphalt bits, chisels, trenching machines, or combinations thereof.

DETAILED DESCRIPTION OF THE INVENTION

Figure 1:
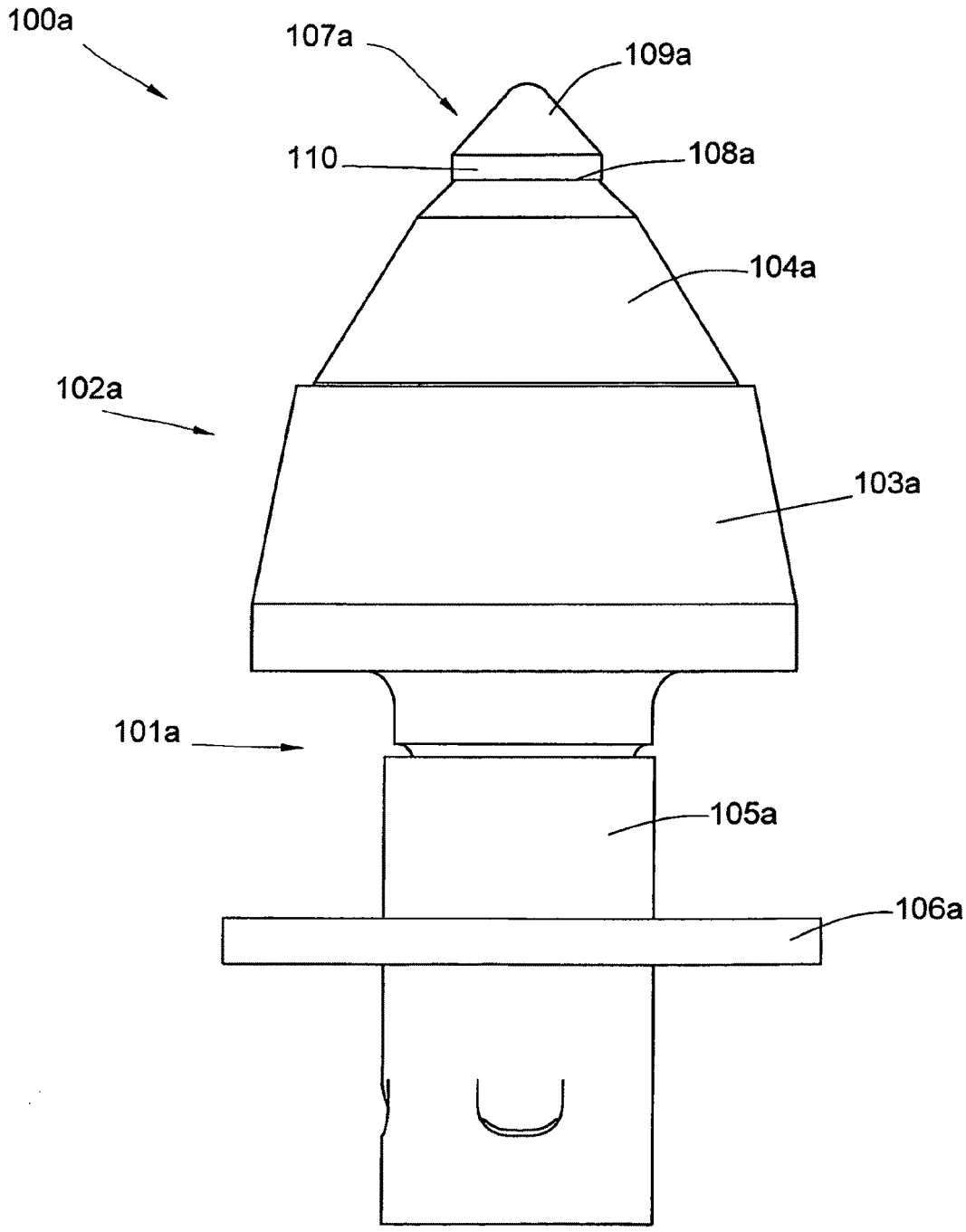
FIG. 1 is a perspective diagram of an embodiment of a high impact resistant tool.

FIG. 1 discloses an embodiment of a high impact resistant tool 100*a* which may be used in machines in mining, asphalt milling, or trenching industries. The tool 100*a* may comprise a shank 101*a* and a body 102*a*, the body 102*a* being divided into first and second segments 103*a*, 104*a*. The first segment 103*a* may generally be made of steel, while the second segment 104*a* may be made of a harder material such as a cemented metal carbide. The second segment 104*a* may be bonded to the first segment 103*a* by brazing to prevent the second segment 104*a* from detaching from the first segment 103*a*.

The shank 101*a* may be adapted to be attached to a driving mechanism. A protective spring sleeve 105*a* may be disposed around the shank 101*a* both for protection and to allow the high impact resistant tool 100 to be press fit into a holder while still being able to rotate. A washer 106*a* may also be disposed around the shank 101*a* such that when the high impact resistant tool 100*a* is inserted into a holder the washer 106*a* protects an upper surface of the holder and also facilitates rotation of the tool 100. The washer 106*a* and sleeve 105*a* may be advantageous since they may protect the holder which may be costly to replace.

The high impact resistant tool 100*a* also comprises a tip 107*a* bonded to a end 108*a* of the frustoconical second segment 104*a* of the body 102*a*. The tip 107*a* comprises a superhard material 109*a* bonded to a cemented metal carbide substrate 110*a* at a non-planar interface, as discussed below. The tip 107*a* may be bonded to the cemented metal carbide substrate 110*a* through a high pressure-high temperature process.

The superhard material 109*a* may be a polycrystalline structure with an average grain size of 10 to 100 microns. The superhard material 109*a* may comprise diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 percent by weight, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof.

The superhard material 109*a* may also comprise a 1 to 5 percent concentration of tantalum by weight as a binding agent. Other binding agents that may be used with the present invention include iron, cobalt, nickel, silicon, hydroxide, hydride, hydrate, phosphorus-oxide, phosphoric acid, carbonate, lanthanide, actinide, phosphate hydrate, hydrogen phosphate, phosphorus carbonate, alkali metals, ruthenium, rhodium, niobium, palladium, chromium, molybdenum, manganese, tantalum or combinations thereof. In some embodiments, the binding agent is added directly to a mixture that forms the superhard material 109*a* mixture before the HPHT processing and do not rely on the binding agent migrating from the cemented metal carbide substrate 110 into the mixture during the HPHT processing.

The cemented metal carbide substrate 110*a* may comprise a concentration of cobalt of 1 to 40 percent by weight and, more preferably, 5 to 10 percent by weight. During HPHT processing, some of the cobalt may infiltrate into the superhard material 109*a* such that the cemented metal carbide substrate 110*a* comprises a slightly lower cobalt concentration than before the HPHT process. The superhard material 109*a* may preferably comprise a 1 to 5 percent cobalt concentration by weight after the cobalt or other binding agent infiltrates the superhard material 109*a* during HPHT processing.

Figures 2, 2A, 3:
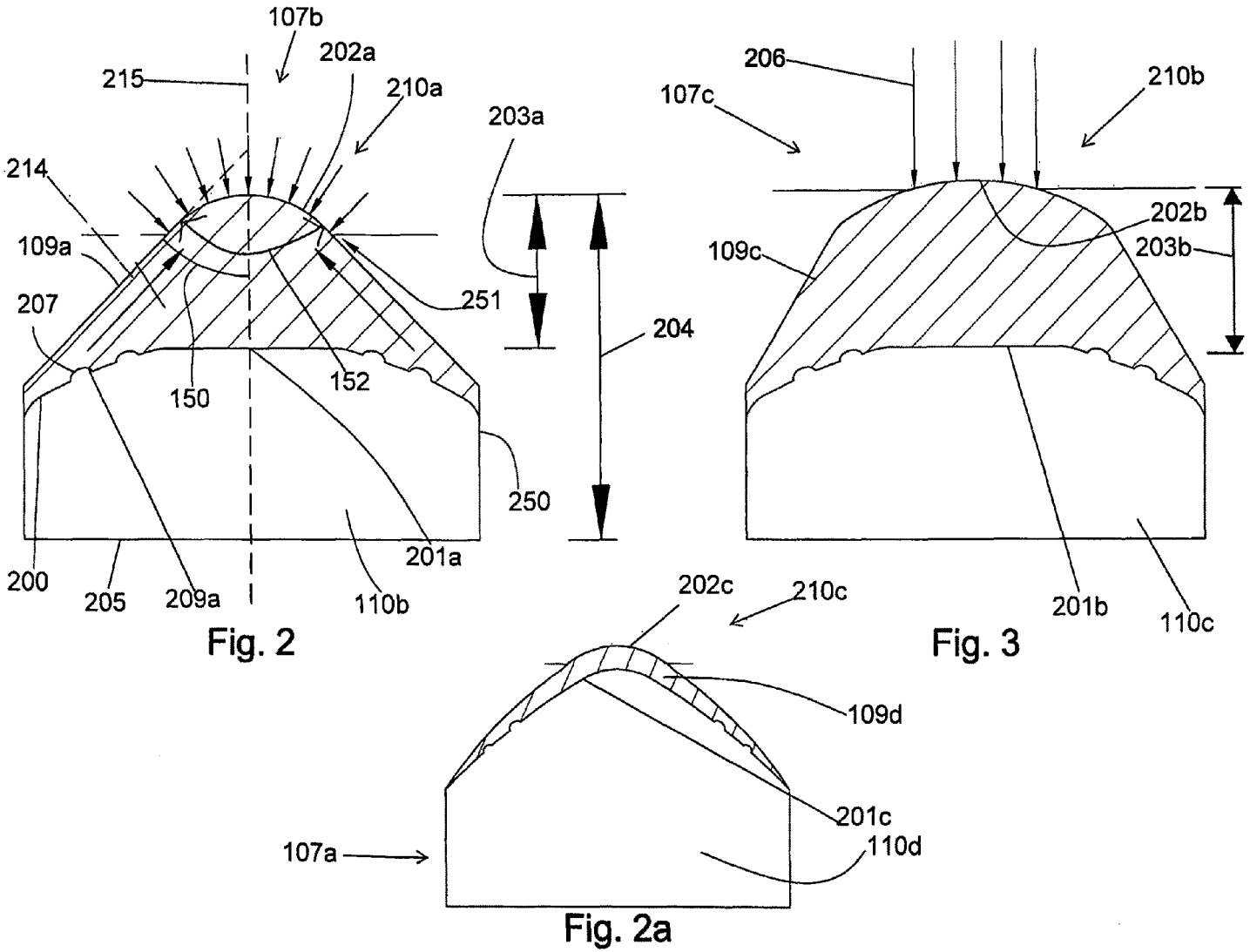
FIG. 2 is a cross-sectional diagram of an embodiment of a tip with a pointed geometry.
FIG. 2*a* is a cross-sectional diagram of another embodiment a tip with a pointed geometry.
FIG. 3 is a cross-sectional diagram of an embodiment of a tip with a less pointed geometry.

Now referring to FIG. 2 that illustrates an embodiment of a tip 107*b* that includes a cemented metal carbide substrate 110*b*. The cemented metal carbide substrate 110*b* comprises a tapered surface 200 starting from a cylindrical rim 250 of the cemented metal carbide substrate 110*b* and ending at an elevated, flatted, central region 201 formed in the cemented metal carbide substrate 110*b*.

The superhard material 109*b* comprises a substantially pointed geometry 210*a* with a sharp apex 202*a* comprising a radius of curvature of 0.050 to 0.125 inches. In some embodiments, the radius of curvature is 0.090 to 0.110 inches. It is believed that the apex 202*a* is adapted to distribute impact forces across the central region 201*a*, which may help prevent the superhard material 109*b* from chipping or breaking.

The superhard material 109*b* may comprise a thickness 203 of 0.100 to 0.500 inches from the apex 202*a* to the central region 201*a* and, more preferably, from 0.125 to 0.275 inches. The superhard material 109*b* and the cemented metal carbide substrate 110*b* may comprise a total thickness 204 of 0.200 to 0.700 inches from the apex 202 to a base 205 of the cemented metal carbide substrate 110*b*. The apex 202*a* may allow the high impact resistant tool 100 illustrated in FIG. 1 to more easily cleave asphalt, rock, or other formations.

The pointed geometry 210*a* of the superhard material 109*b* may comprise a side 214 which forms an angle 150 of 35 to 55 degrees with a central axis 215 of the tip 107*b*, though the angle 150 may preferably be substantially 45 degrees. The included angle 152 may be a 90 degree angle, although in some embodiments, the included angle 152 is 85 to 95 degrees.

The pointed geometry 210*a* may also comprise a convex side or a concave side. The tapered surface 200 of the cemented metal carbide substrate 110*b* may incorporate nodules 207 at a non-planar interface 209*a* between the superhard material 109*b* and the cemented metal carbide substrate 110*b*, which may provide a greater surface area on the cemented metal carbide substrate 110*b*, thereby providing a stronger interface. The tapered surface 200 may also incorporate grooves, dimples, protrusions, reverse dimples, or combinations thereof. The tapered surface 200 may be convex, as in the current embodiment of the tip 107*b*, although the tapered surface may be concave in other embodiments.

Advantages of having a pointed apex 202*a* of superhard material 109 as illustrated in FIG. 2 will now be compared to that of a tip 107*c* having a superhard material 109*c* and an apex 202*b* that is blunter than the apex 202*a*, as illustrated in FIG. 3. A representative example of a tip 107*b* illustrated in FIG. 2 includes a pointed geometry 210*a* that has a radius of curvature of 0.094 inches and a thickness 203*a* of 0.150 inch from the apex 202*a* to the central region 201*a*. FIG. 3 is a representative example of another embodiment of a tip 107*c* that includes a geometry 210*b* more blunt than the geometry 210 in FIG. 2. The tip 107*b* includes a superhard material 109*c* that has an apex 202*b* with a radius of curvature of 0.160 inches and a thickness 203*b* of 0.200 inch from the apex 202*b* to the central region 201*b*.

The performance of the geometries 210*a* and 210*b* were compared a drop test performed at Novatek International, Inc. located in Provo, Utah. Using an Instron Dynatup 9250G drop test machine, the tips 107*b* and 107*c* were secured to a base of the machine and weights comprising tungsten carbide targets were dropped onto the tips 107*b* and 107*c*.

It was shown that the geometry 210*a* of the tip 107*b* penetrated deeper into the tungsten carbide target, thereby allowing more surface area of the superhard material 109*b* to absorb the energy from the falling target. The greater surface area of the superhard material 109*b* better buttressed the portion of the superhard material 109*b* that penetrated the target, thereby effectively converting bending and shear loading of the superhard material 109*b* into a more beneficial quasi-hydrostatic type compressive forces. As a result, the load carrying capabilities of the superhard material 109 *b* drastically increased.

On the other hand, the geometry 210*b* of the tip 107*c* is blunter and as a result the apex 202*b* of the superhard material 109*c* hardly penetrated into the tungsten carbide target. As a result, there was comparatively less surface area of the superhard material 109*c* over which to spread the energy, providing little support to buttress the superhard material 109*c*. Consequently, this caused the superhard material 109*c* to fail in shear/bending at a much lower load despite the fact that the superhard material 109*c* comprised a larger surface area than that of superhard material 109*b* and used the same grade of diamond and carbide as the superhard material 109*b*.

In the event, the pointed geometry 210*a* having an apex 202*a* of the superhard material 109*b* surprisingly required about 5 times more energy (measured in joules) to break than the blunter geometry 210*b* having an apex 202*b* of the superhard material 109*c* of FIG. 3. That is, the average embodiment of FIG. 2 required the application of about 130 joules of energy before the tip 107*b* fractured, whereas the average embodiment of FIG. 3 required the application of about 24 joules of energy before it fracture. It is believed that the much greater in the energy required to fracture an embodiment of the tip 107*b* having a geometry 210*a* is because the load was distributed across a greater surface area in the embodiment of FIG. 2 than that of the geometry 210*b* embodiment of the tip 107*c* illustrated in FIG. 3.

Surprisingly, in the embodiment of FIG. 2, when the tip 107*b* finally broke, the crack initiation point 251 was below the apex 202*a*. This is believed to result from the tungsten carbide target pressurizing the flanks of the superhard material 109*b* in the portion that penetrated the target. It is believed that this results in greater hydrostatic stress loading in the superhard material 109*c*. It is also believed that since the apex 202*a* was still intact after the fracture that the superhard material 109*b* will still be able to withstand high impacts, thereby prolonging the useful life of the superhard material 109*b* even after chipping or fracture begins.

In addition, a third embodiment of a tip 107*c* illustrated in FIG. 2*a* was tested as described above. Tip 107*d* includes a geometry 210*c* with a superhard material 109*d*. The superhard material 109*d* comprises an apex 202*c* having a thickness 203*c* of 0.035 inches between an apex 202*c* and a central region 201*c* and a radius of curvature of 0.094 inches at the apex 202*c*.

Figure 3A:
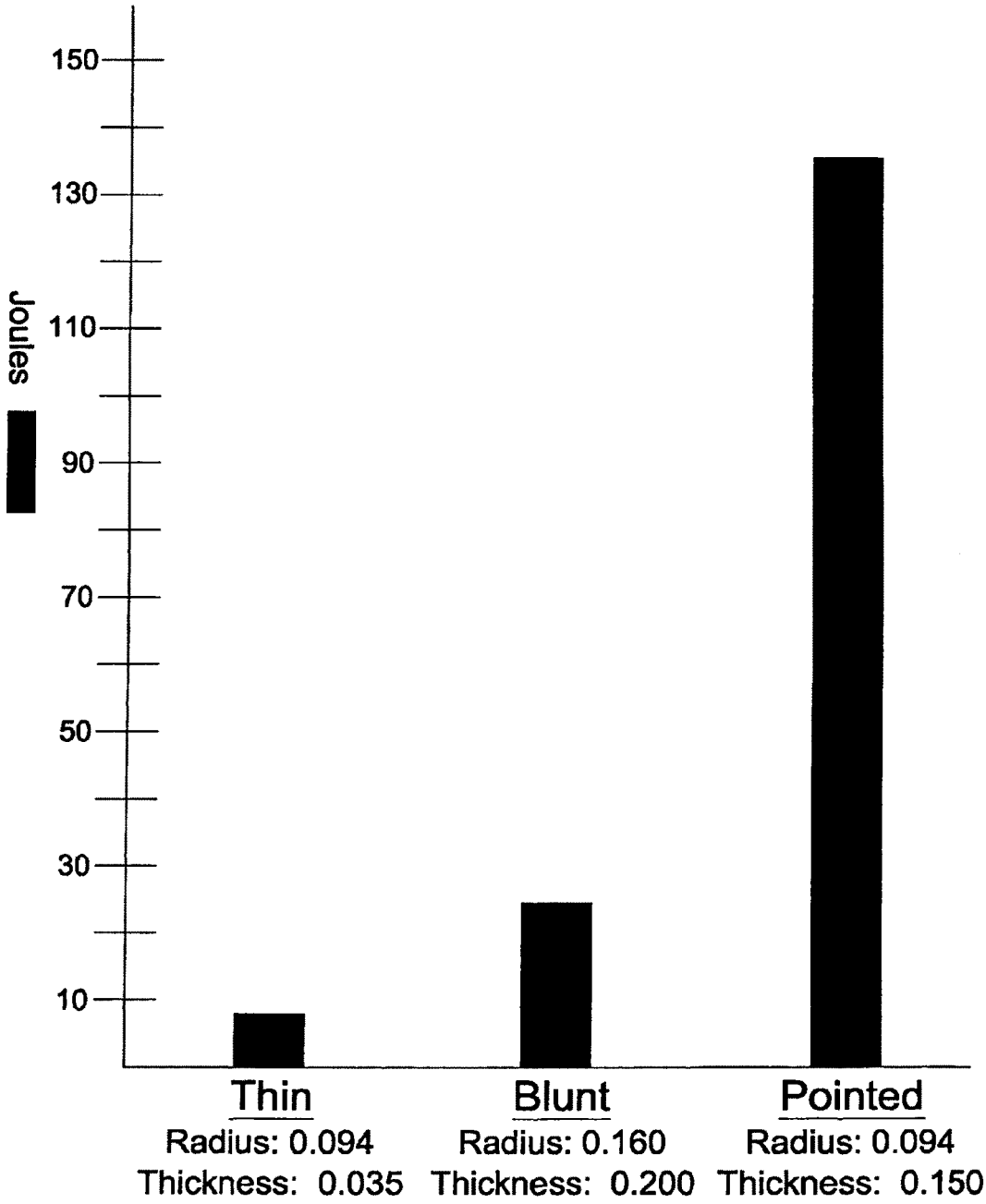
FIG. 3*a* is a diagram of impact test results of the embodiments illustrated in FIGS. 2, 2*a*, and 3.

FIG. 3*a* illustrates the results of the drop tests performed on the embodiments of tips 107*b*, 107*c*, and 107*d*. The tip 107*d* with a superhard material 109*d* having the geometry 210*c* required an energy in the range of 8 to 15 joules to break. The tip 107*c* with a superhard material 109*c* having the relatively blunter geometry 210*b* with the apex 202*b* having a radius of curvature of 0.160 inches and a thickness 203*b* of 0.200 inches, which the inventors believed would outperform the geometries 210*a* and 210*b* required 20-25 joules of energy to break. The impact force measured when the tip 107*c* broke was 75 kilo-newtons. The tip 107*b* with a superhard material 109*b* having a relatively pointed geometry 210*a* with the apex 202*a* having a radius of curvature of 0.094 inches and a thickness 203*a* of 0.150 inch required about 130 joules to break. Although the Instron drop test machine was only calibrated to measure up to 88 kilo-newtons, which the tip 1076 exceeded before it broke, the inventors were able to extrapolate the data to determine that the tip 107*b* probably experienced about 105 kilo-newtons when it broke.

As can be seen, embodiments of tips that include a superhard material having the feature of being thicker than 0.100 inches, such as tip 107*c*, or having the feature of a radius of curvature of 0.075 to 0.125 inch, such as tip 107*d*, is not enough to achieve the impact resistance of the tip 107*b*. Rather, it is unexpectedly synergistic to combine these two features.

The performance of the present invention is not presently found in commercially available products or in the prior art. In the prior art, it was believed that an apex of a superhard material, such as diamond, having a sharp radius of curvature of 0.075 to 0.125 inches would break because the radius of curvature was too sharp. To avoid this, rounded and semi-spherical geometries are commercially used today. These inserts were drop-tested and withstood impacts having energies between 5 and 20 joules, results that were acceptable in most commercial applications, albeit unsuitable for drilling very hard rock formations.

Figure 3C:
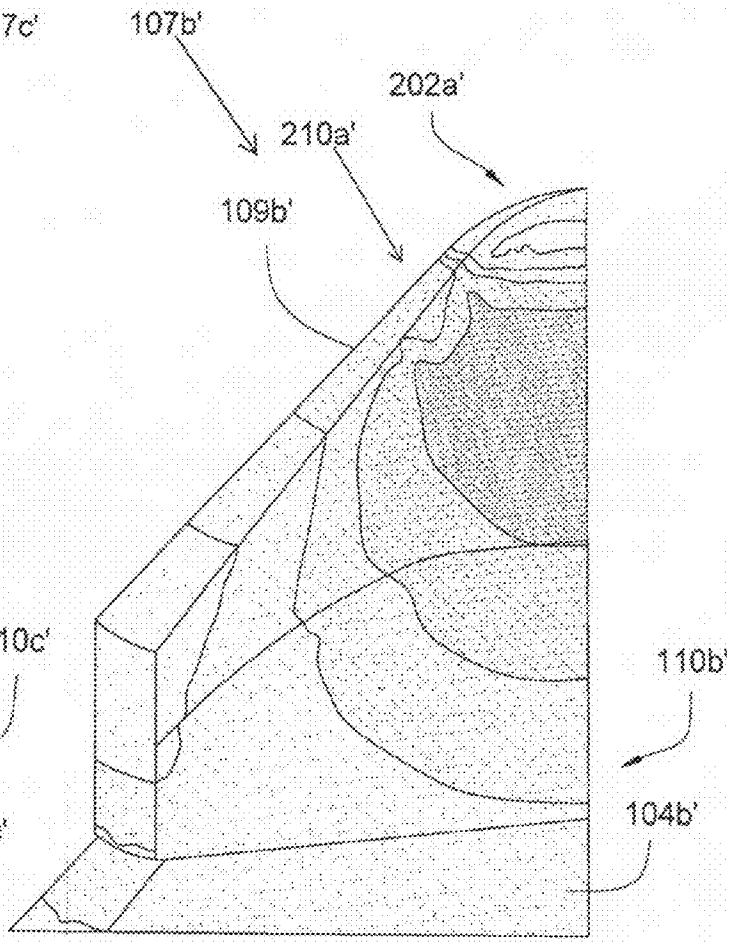
FIG. 3*c* is diagram of a Finite Element Analysis of the embodiment illustrated in FIG. 3.
Figure 3B:
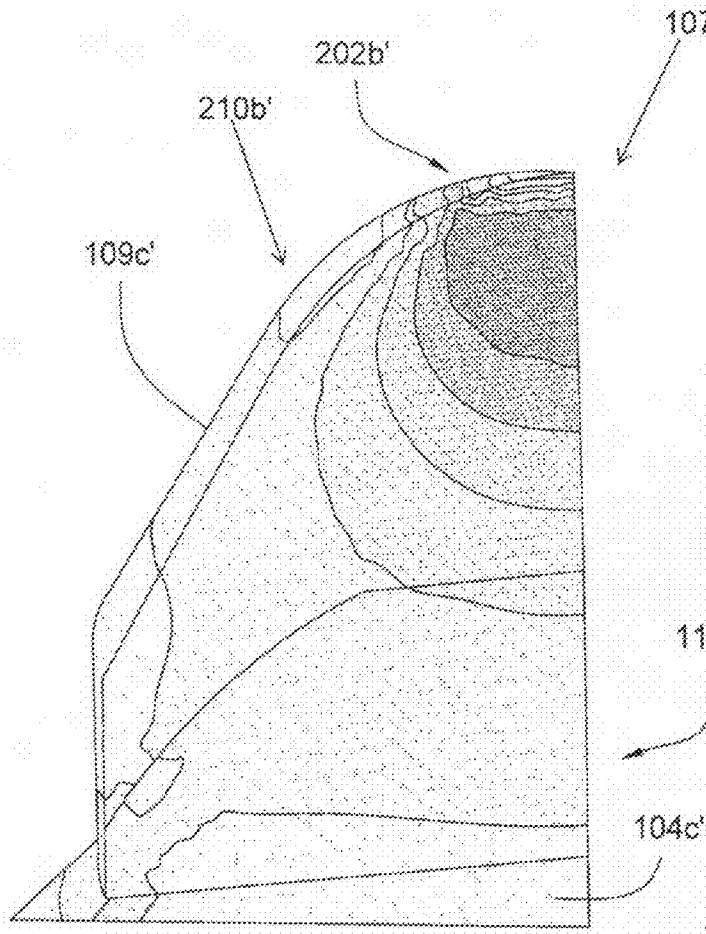
FIG. 3*b* is diagram of a Finite Element Analysis of the embodiment illustrated in FIG. 2.

After the surprising results of the above test, a Finite Element Analysis (FEA) was conducted upon the tips 107*b* and 107*c*, the results of which are shown in FIGS. 3*b* and 3*c*. FIG. 3*b* discloses an FEA 107*c*' of the tip 107*c* from FIG. 3. The FEA 107*c*' includes an FEA 109*c*' of the superhard material 109 having a geometry 210*b* and, more specifically, with an apex 202*b* having a radius of curvature of 0.160 inches and a thickness 203*b* of 0.200 inches while enduring the energy at which the tip 107*c* broke while performing the drop test. In addition, FIG. 3*b* illustrates an FEA 110*c*' of the cemented metal carbide substrate 110*c* and a second segment 104*c*', similar to the second segment 104 illustrated in FIG. 1 that can be a cemented metal carbide, such as tungsten carbide.

FIG. 3*c* discloses an FEA 107*b*' of the tip 107*b* from FIG. 2. The FEA 107*b*' includes an FEA 109*b*' of the superhard material 109*b* having a geometry 210*a* and, more specifically, with an apex 202*a* having a radius of curvature of 0.094 inches and a thickness 203*a* of 0.150 inches while enduring the energy at which the tip 107*b* broke while performing the drop test. In addition, FIG. 3*c* illustrates an FEA 110*b*' of the cemented metal carbide substrate 110*b* and a second segment 104*b*', similar to the second segment 104 illustrated in FIG. 1 that can be a cemented metal carbide, such as tungsten carbide.

As discussed, the tips 107*b* and 107*c* broke when subjected to the same stress during the test. Nonetheless, the difference in the geometries 210*a* and 210*b* of the superhard material 109*b* and 109*c*, respectively, caused a significant difference in the load required to reach the Von Mises stress level at which each of the tips 107*b* and 107*c* broke. This is because the geometry 210*a* with the pointed apex 202*a* distributed the loads more efficiently across the superhard material 109*b* than the blunter apex 202*b* distributed the load across the superhard material 109*c*.

In FIGS. 3*b* and 3*c*, stress concentrations are represented by the darkness of the regions, the lighter regions representing lower stress concentrations and the darker regions represent greater stress concentrations. As can be seen, the FEA 107*c*' illustrates that the stress in tip 107*c* is concentrated near the apex 202*b*' and are both larger and higher in bending and shear. In comparison, the FEA 107*b*' illustrates that the stress in tip 107*b* is distributed further from the apex 202*a*' and distributes the stresses more efficiently throughout the superhard material 109*b*' due to their hydrostatic nature.

In the FEA 107*c*', it can be seen that both the higher and lower stresses are concentrated in the superhard material 109*c*, as the FEA 109*c*' indicates. These combined stresses, it is believed, causes transverse rupture to actually occur in the superhard material 109*c*, which is generally more brittle than the softer carbide substrate.

In the FEA 107*b*', however, the FEA 109*b*' indicates that the majority of high stress remains within the superhard material 109*b* while the lower stresses are actually within the carbide substrate 110*b* that is more capable of handling the transverse rupture, as indicated in FEA 110*b*'. Thus, it is believed that the thickness of the superhard material is critical to the ability of the superhard material to withstand greater impact forces; if the superhard material is too thick it increases the likelihood that transverse rupture of the superhard material will occur, but if the superhard material is too thin it decreases the ability of the superhard material to support itself and withstand higher impact forces.

FIGS. 4 through 10 disclose various possible embodiments of tips with different combinations of geometries of superhard materials and tapered surfaces of cemented metal carbide substrates.

Figures 4, 5, 6, 7, 8, 9, 10, 11:
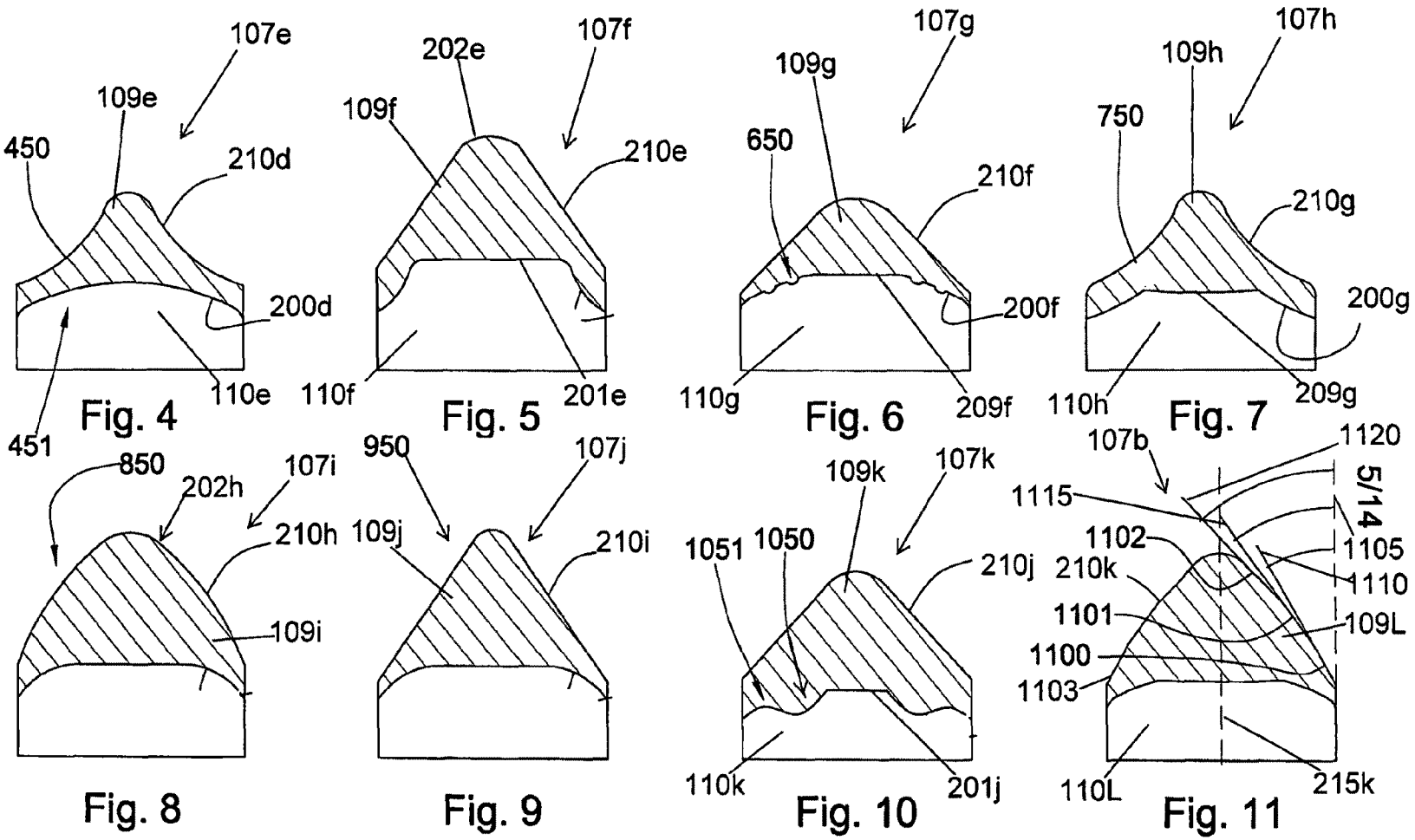
FIG. 4 is a cross-sectional diagram of another embodiment of a tip with a pointed geometry.
FIG. 5 is a cross-sectional diagram of another embodiment of a tip with a pointed geometry.
FIG. 6 is a cross-sectional diagram of another embodiment of a tip with a pointed geometry.
FIG. 7 is a cross-sectional diagram of another embodiment of a tip with a pointed geometry.
FIG. 8 is a cross-sectional diagram of another embodiment of a tip with a pointed geometry.
FIG. 9 is a cross-sectional diagram of another embodiment of a tip with a pointed geometry.
FIG. 10 is a cross-sectional diagram of another embodiment of a tip with a pointed geometry.
FIG. 11 is a cross-sectional diagram of another embodiment of a tip with a pointed geometry.

FIG. 4 illustrates a tip 107*e* having a superhard material 109*e* with a geometry 210*d* that has a concave side 450 and a continuous convex substrate geometry 451 at the tapered surface 200 of the cemented metal carbide segment.

FIG. 5 comprises an embodiment of a tip 107*f* having a superhard material 109*f* with a geometry 210*e* that is thicker from the apex 202*e* to the central region 201 of the cemented metal carbide substrate 110*f*, while still maintaining radius of curvature of 0.075 to 0.125 inches at the apex 202*e*.

FIG. 6 illustrates a tip 107*g* that includes grooves 650 formed in the cemented metal carbide substrate 110*g* to increase the strength of the interface 209*f* between the superhard material 109*g* and the cemented metal carbide substrate 110*g*.

FIG. 7 illustrates a tip 107*h* that includes a superhard material 109*h* having a geometry 210*g* that is slightly concave at the sides 750 of the superhard material 109*h* and at the interface 209*g* between the tapered surface 200*g* of the cemented metal carbide substrate 110 *h* and the superhard material 109*h*.

FIG. 8 discloses a tip 107*i* that includes a superhard material 109*i* having a geometry 210*h* that is slightly convex at the sides 850 of the superhard material 109*i* while still maintaining a radius of curvature of 0.075 to 0.125 inches at the apex 202*h*.

FIG. 9 discloses a tip 107*j* that includes a superhard material 109*j* having a geometry 210*i* that has flat sides 950.

FIG. 10 discloses a tip 107*k* that includes a superhard material 109*k* having a geometry 210*j* that includes a cemented metal carbide substrate 110*k* having concave portions 1051 and convex portions 1050 and a generally flatted central region 201*j*.

Now referring to FIG. 11, a tip 107*l* that includes a superhard material 109*l* having a geometry 210*k* that includes convex surface 1103. The convex surface 1103 comprises a first angle 1110 from an axis 1105 parallel to a central axis 215*k* in a lower portion 1100 of the superhard material 109*l*; a second angle 1115 from the axis 1105 in a middle portion of the superhard material 109*l*; and a third angle 1120 from the axis 1105 in an upper portion of the superhard material 109*l*. The angle 1110 may be at substantially 25 to 33 degrees from axis 1105, the middle portion 1101, which may make up a majority of the convex surface 1103, may have an angle 1115 at substantially 33 to 40 degrees from the axis 1105, and the upper portion 1102 of the convex surface 1103 may have an angle 1120 at about 40 to 50 degrees from the axis 1105.

Figure 12:
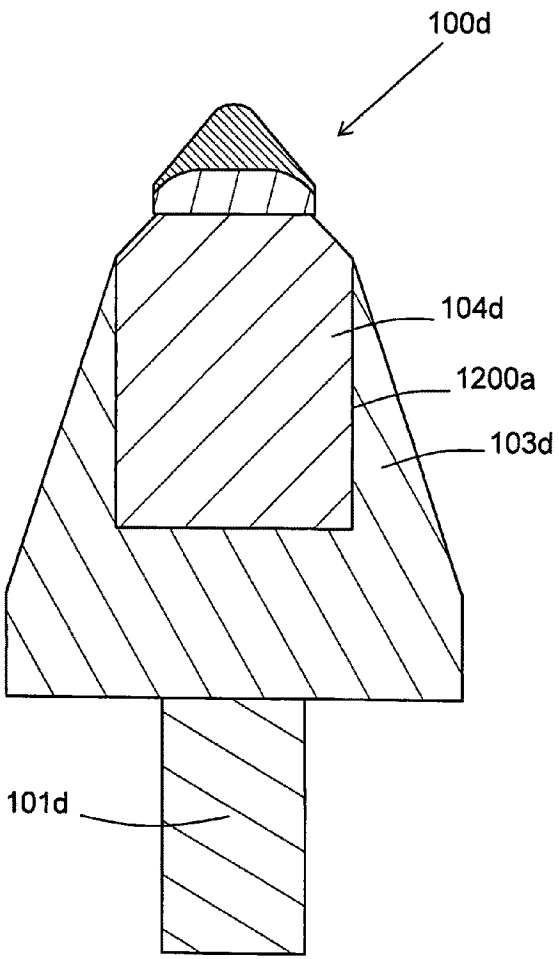
FIG. 12 is a cross-sectional diagram of another embodiment of a high impact resistant tool.

FIG. 12 discloses an embodiment of a high impact resistant tool 100*d* having a second segment 104*d* be press fit into a bore 1200*a* of a first segment 103*d*. This may be advantageous in embodiments which comprise a shank 101*d* coated with a hard material. A high temperature may be required to apply the hard material coating to the shank 101*d*. If the first segment 103*d* is brazed to the second segment 104*d* to effect a bond between the segments 103*d*, 104*d*, the heat used to apply the hard material coating to the shank 101*d* could undesirably cause the braze between the segments 103*d*, 104*d* to flow again. A similar same problem may occur if the segments 103*d*, 104*d* are brazed together after the hard material is applied, although in this instance a high temperature applied to the braze may affect the hard material coating. Using a press fit may allow the second segment 104*d* to be attached to the first segment 103*d* without affecting any other coatings or brazes on the high impact resistant tool 100*d*. The depth of the bore 1200*a* within the first segment 103*d* and a size of the second segment 104*d* may be adjusted to optimize wear resistance and cost effectiveness of the high impact resistant tool 100*d* in order to reduce body wash and other wear to the first segment 103*d*.

Figure 13:
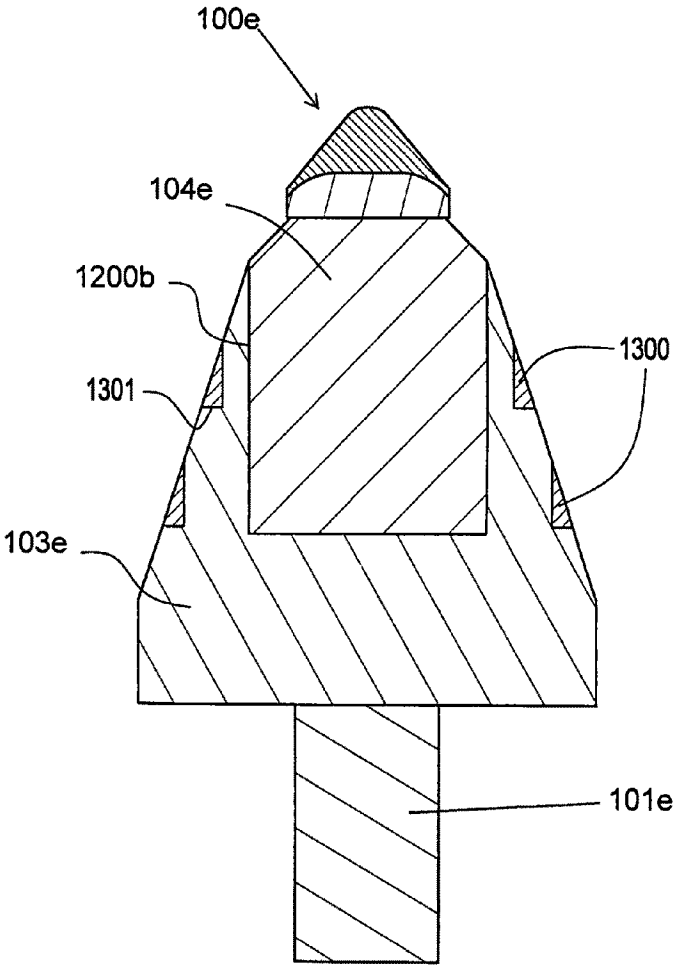
FIG. 13 is a cross-sectional diagram of another embodiment of a high impact resistant tool

FIG. 13 discloses another embodiment of a high impact resistant tool 100*e* that may comprise one or more rings 1300 of hard metal or superhard material disposed around the first segment 103*e*. The ring 1300 may be inserted into a groove 1301 or recess formed in the first segment 103*e*. The ring 1300 may also comprise a tapered outer circumference such that the outer circumference is flush with the first segment 103*e*. The ring 1300 may protect the first segment 103*e* from excessive wear that could affect the press fit of the second segment 104*e* in the bore 1200*b* of the first segment. The first segment 103*e* may also comprise carbide buttons or other strips adapted to protect the first segment 103*e* from wear due to corrosive and impact forces. Silicon carbide, diamond mixed with braze material, diamond grit, or hard facing may also be placed in groove or slots formed in the first segment 103*e* of the high impact resistant tool 100*e* to prevent the first segment 103*e* from wearing. In some embodiments, epoxy with silicon carbide or diamond may be used.

Figure 14:
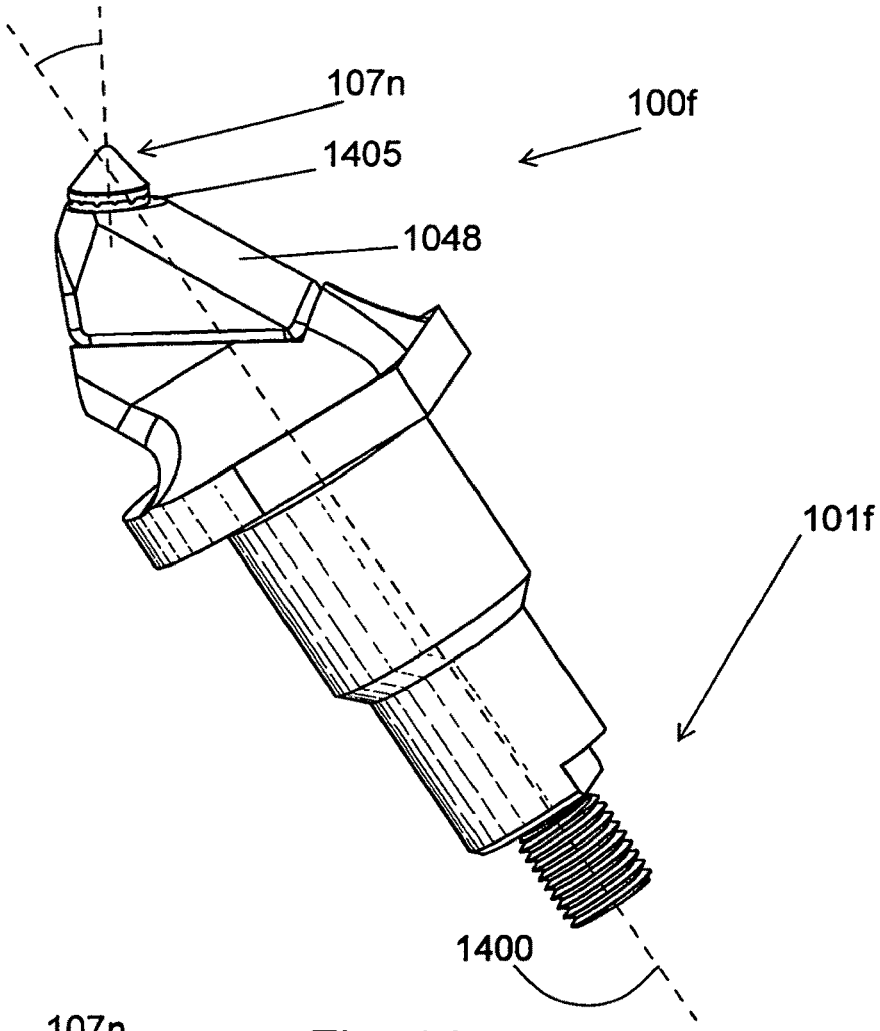
FIG. 14 is an isometric diagram of another embodiment of a high impact resistant tool

FIG. 14 illustrates another embodiment of a high impact resistant tool 100*f* that may be rotationally fixed during an operation. A portion of the shank 101*f* may be threaded to provide axial support to the high impact resistant tool 100*f*, as well as provide a capability for inserting the high impact resistant tool 100*f* into a holder in a trenching machine, a milling machine, or a drilling machine. A planar surface 1405 of a second segment 104*f* may be formed such that the tip 107*f* is presented at an angle with respect to a central axis 1400 of the tool.

Figure 14A:
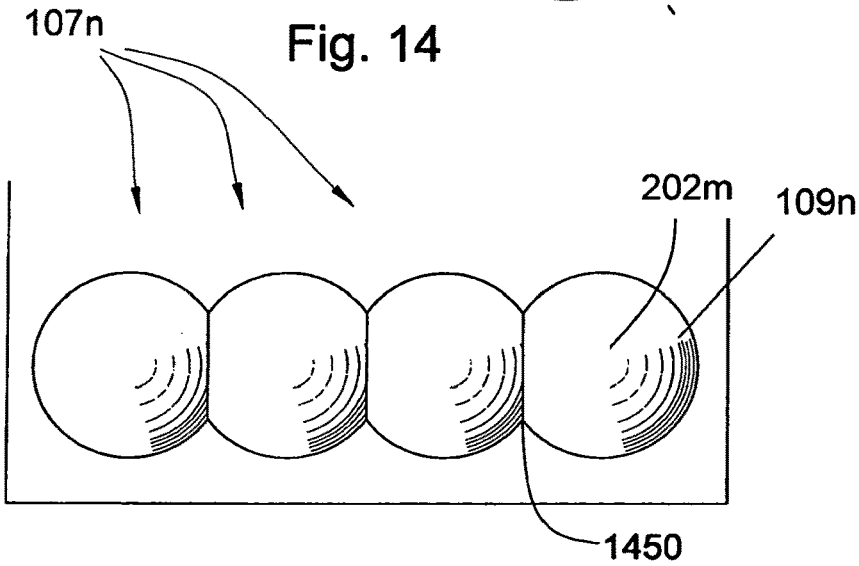
FIG. 14*a* is a plan view of an embodiment of high impact resistant tools.

FIG. 14*a* discloses embodiments of several tips 107*n* comprising a superhard material 109*n* that are disposed along a row. The tips 107*n* comprise flats 1450 on their periphery to allow their apexes 202*m* to be positioned closer together. This may be beneficial in applications where it is desired to minimize the amount of material that flows between the tips 107*n*.

Figure 15:
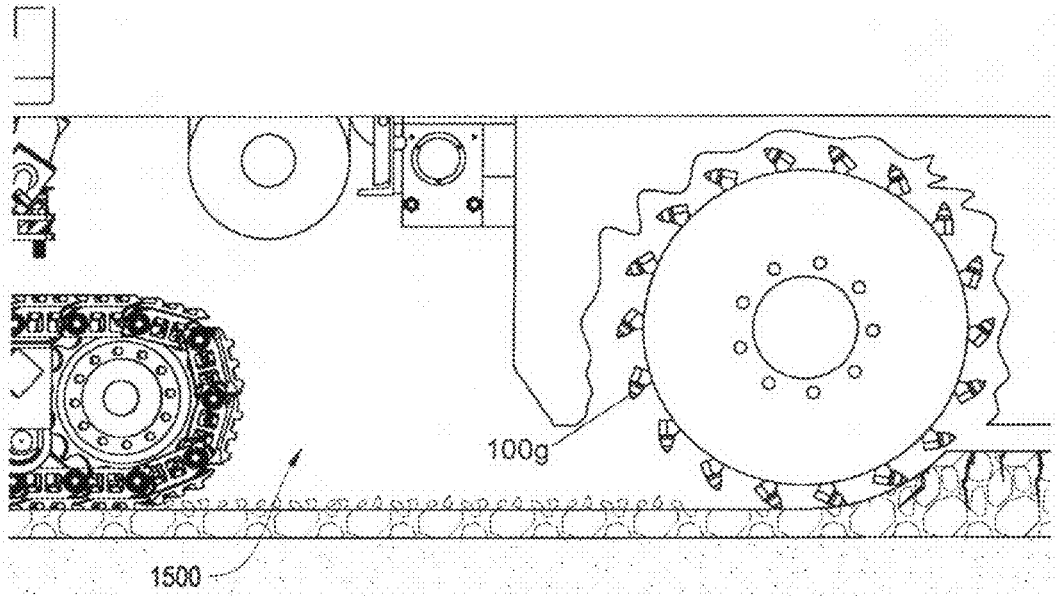
FIG. 15 is a diagram of an embodiment of an asphalt milling machine.

FIG. 15 illustrates an embodiment of a high impact resistant tool 100*g* being used as a pick in an asphalt milling machine 1500. The high impact resistant tool 100 may be used in many different embodiments. The tips as disclosed herein have been tested in locations in the United States and have shown to last 10 to 15 time the life of the currently available milling teeth.

The high impact resistant tool may be an insert in a drill bit, as in the embodiments of FIGS. 16 through 19.

Figure 16:
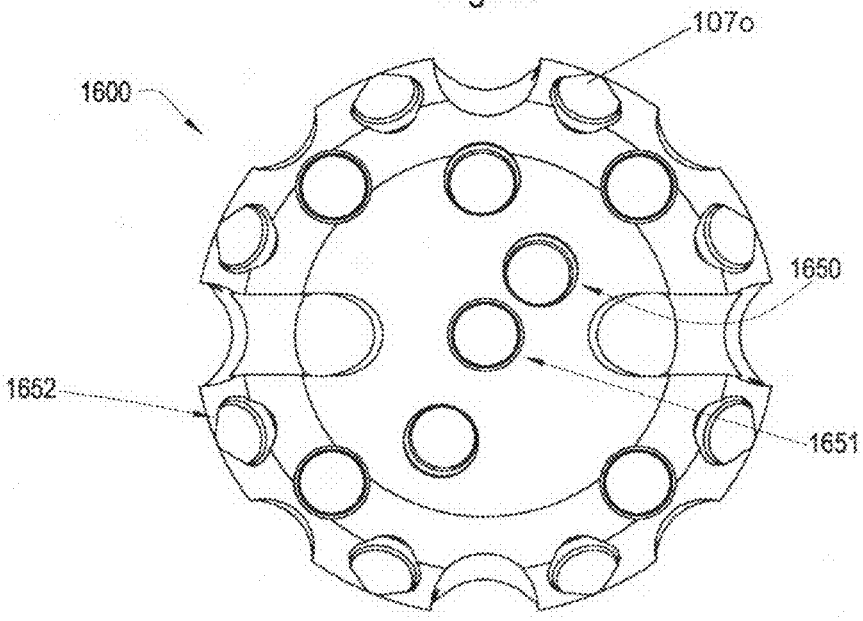
FIG. 16 is an plan view of an embodiment of a percussion bit.

FIG. 16 illustrates a percussion bit 1600, for which the pointed geometry of the tips 107*o* may be useful in central locations 1651 on the bit face 1650 or at the gauge 1652 of the bit 1600.

Figure 17:
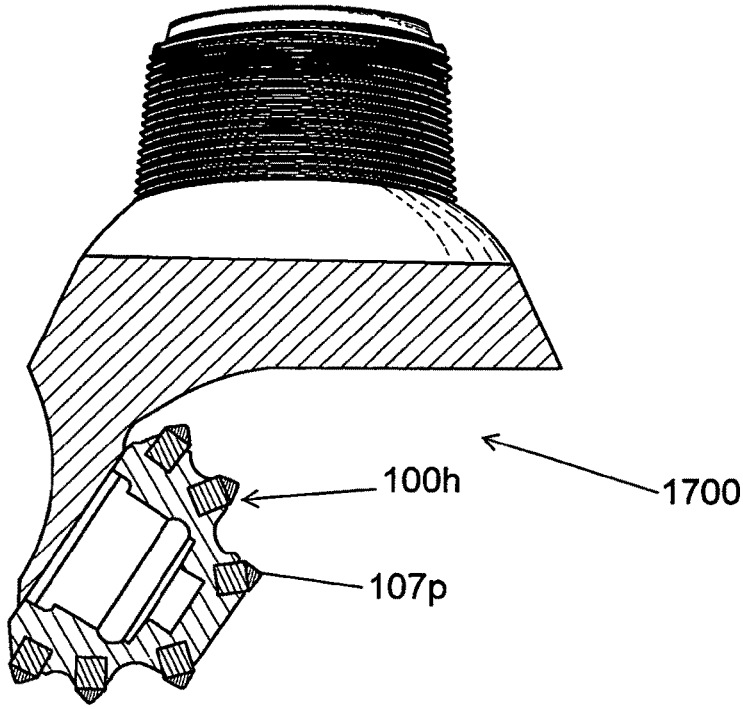
FIG. 17 is a cross-sectional diagram of an embodiment of a roller cone bit.

FIG. 17 illustrates a roller cone bit 1700. Embodiments of high impact resistant tools 100*h* with tips 107*p* may be useful in roller cone bit 1700, where prior art inserts and cutting elements typically fail the formation through compression. The pointed geometries of the tips 107*p* may be angled to enlarge the gauge well bore.

Figure 18:
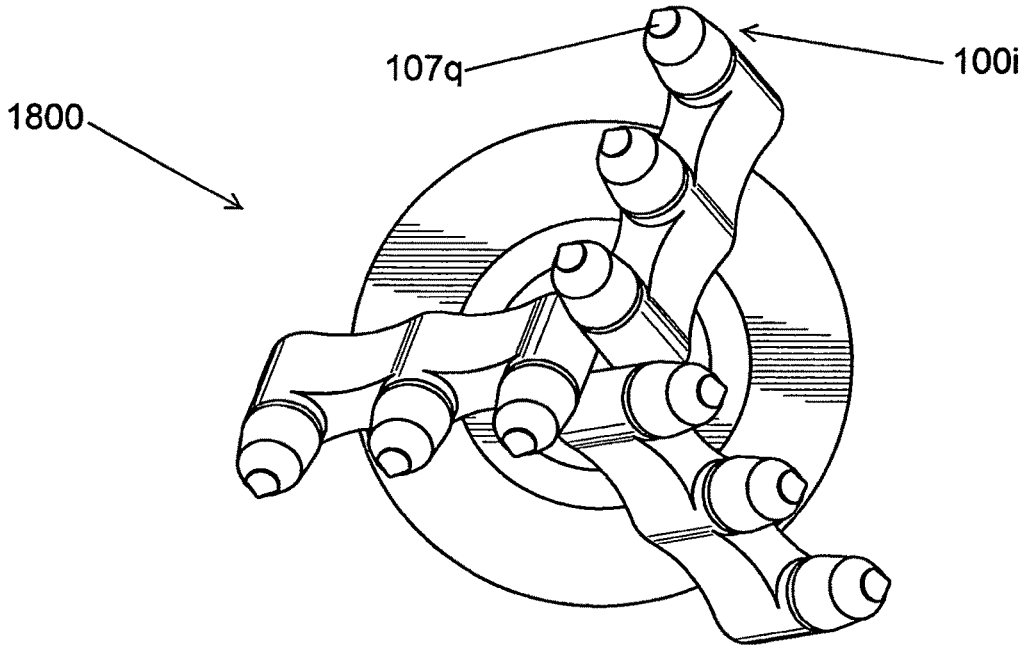
FIG. 18 is a plan view of an embodiment of a mining bit.

FIG. 18 discloses a mining bit 1800 that may also be incorporated with the present invention and uses embodiments of a high impact resistant tool 100*i* and tips 107*q*.

Figure 19:
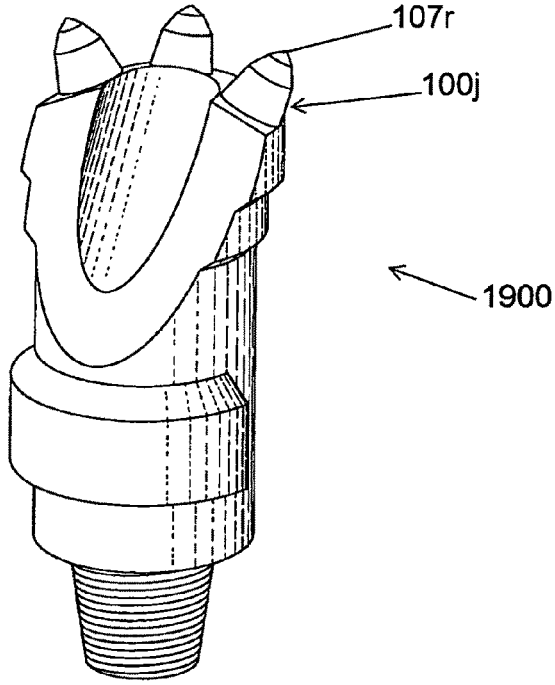
FIG. 19 is an isometric diagram of an embodiment of a drill bit.

FIG. 19 discloses a drill bit 1900 typically used in horizontal drilling that uses embodiments of a high impact resistant tool 100*j* and tips 107*r*.

Figure 20:
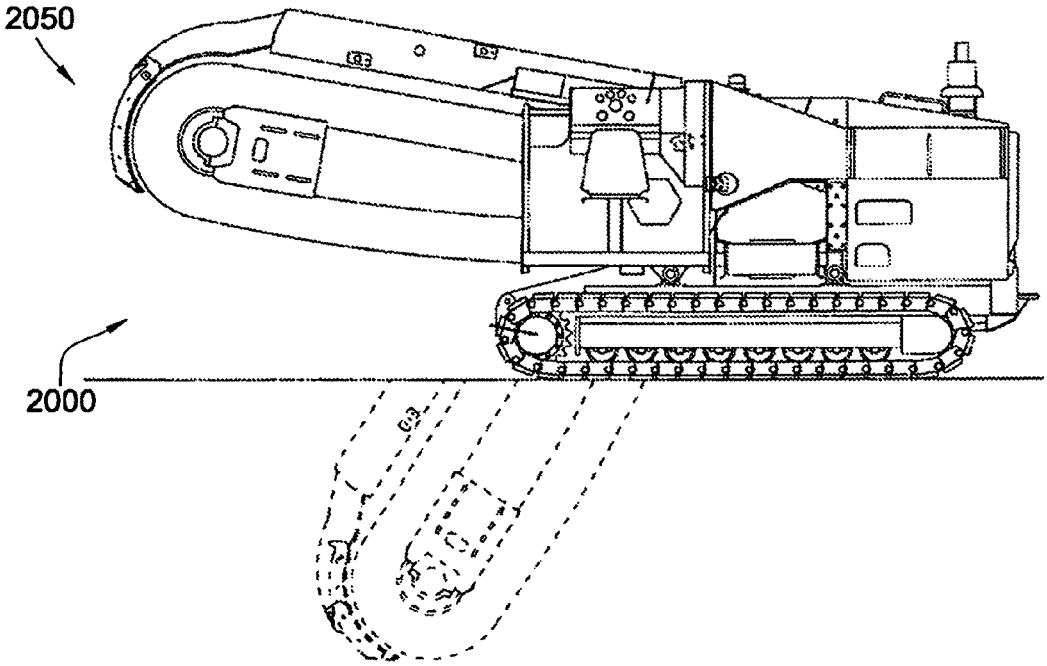
FIG. 20 is a diagram of an embodiment of a trenching machine.

FIG. 20 discloses a trenching machine 2000 that uses embodiments of a high impact resistant tool and tips (not illustrated). The high impact resistant tools may be placed on a chain that rotates around an arm 2050.

Milling machines may also incorporate the present invention. The milling machines may be used to reduce the size of material such as rocks, grain, trash, natural resources, chalk, wood, tires, metal, cars, tables, couches, coal, minerals, chemicals, or other natural resources.

Figure 21:
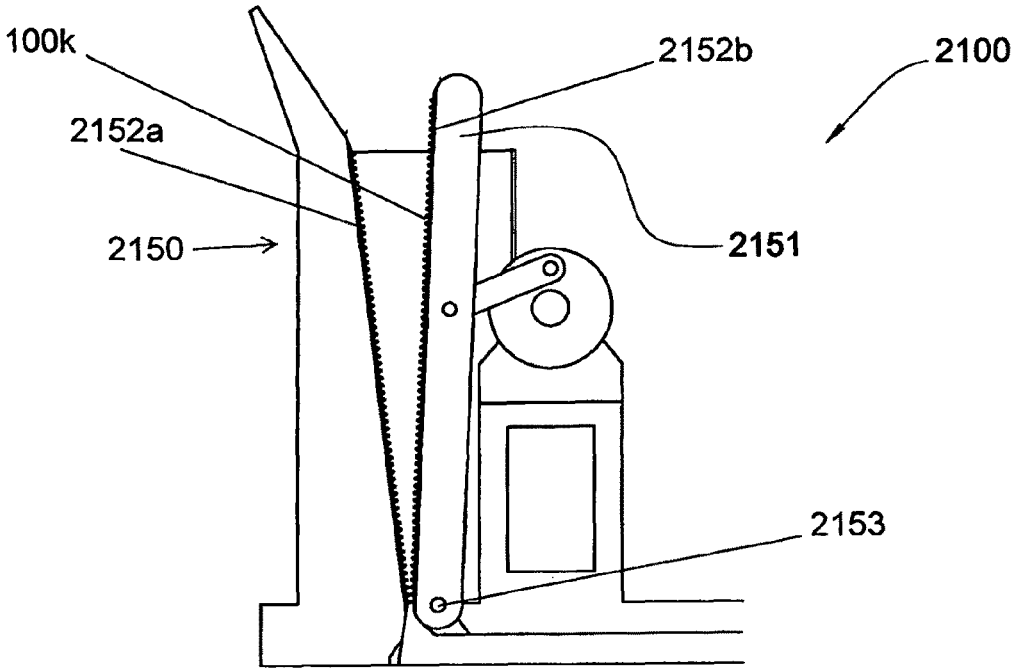
FIG. 21 is a cross-sectional diagram of an embodiment of a jaw crusher.

FIG. 21 illustrates a jaw crusher 2100 that may include a fixed plate 2150 with a wear surface 2152*a* and pivotal plate 2151 with another wear surface 2152*b*. Rock or other materials are reduced as they travel downhole and are crushed between the wear plates 2152*a* and 2152*b*. Embodiments of the high impact resistant tools 100*k* may be fixed to the wear plates 2152*a* and 2152*b*, with the high impact resistant tools optionally becoming larger size as the high impact resistant tools get closer to the pivotal end 2153 of the wear plate 2152*b*.

Figure 22:
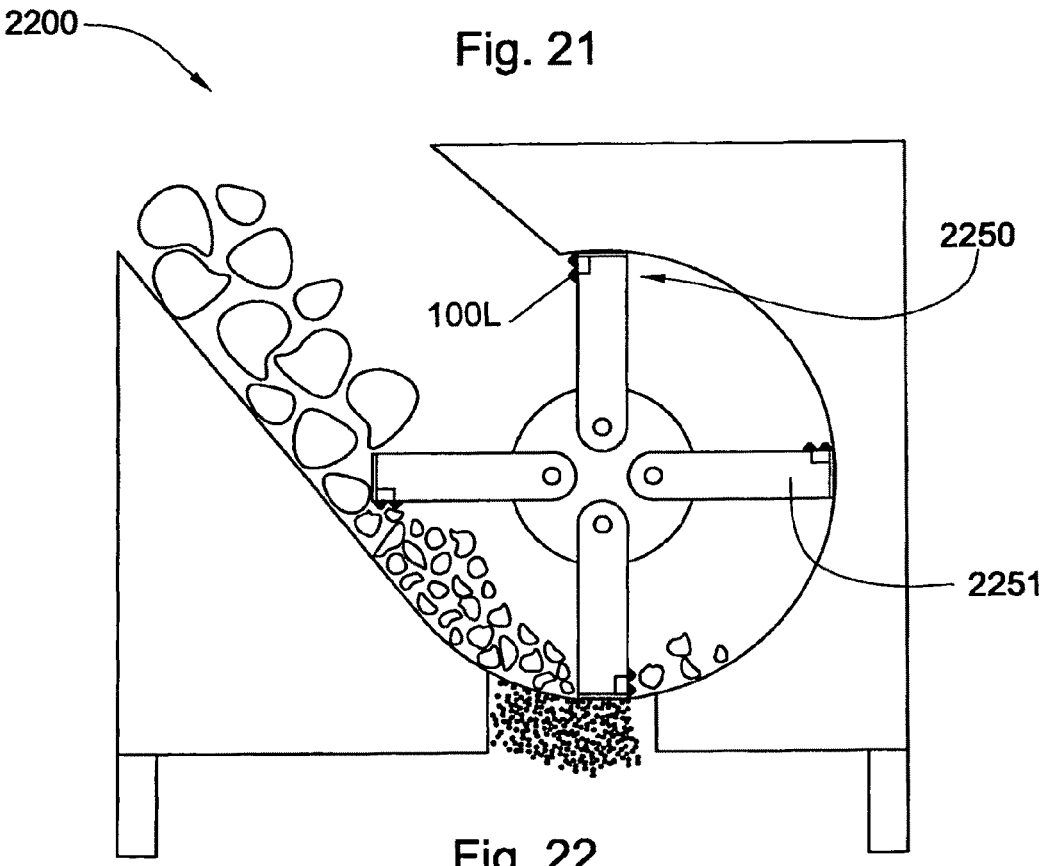
FIG. 22 is a cross-sectional diagram of an embodiment of a hammer mill.

FIG. 22 illustrates a hammer mill 2200 that incorporates embodiments of high impact resistant tools 100*l* at a distal end 2250 of the hammer bodies 2251.

Figure 23:
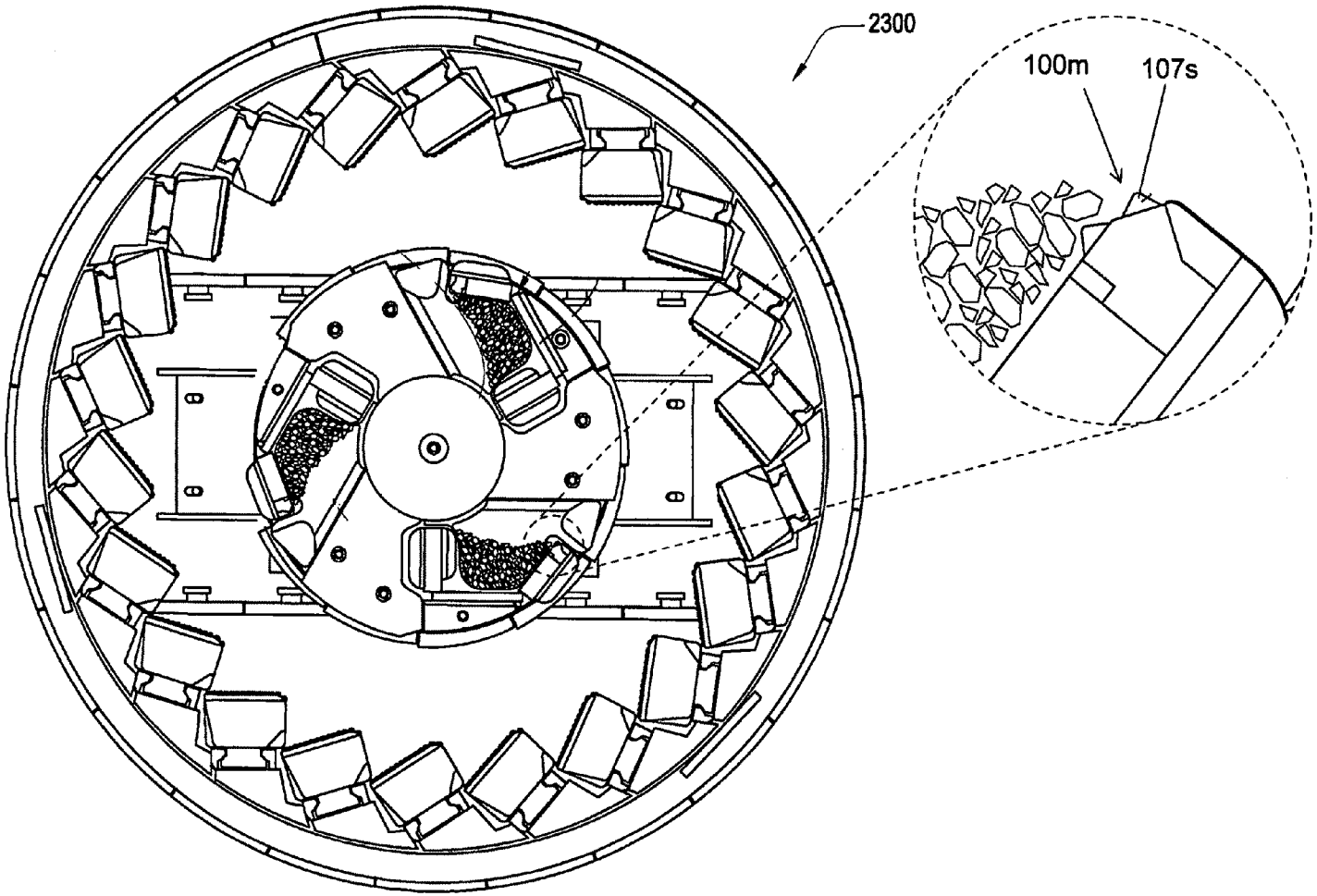
FIG. 23 is a cross-sectional diagram of an embodiment of a vertical shaft impactor.

FIG. 23 illustrates a vertical shaft impactor 2300 may also use embodiments of a high impact resistant tool 100*m* and/or tips 107*s*. They may use the pointed geometries on the targets or on the edges of a central rotor.

Figure 24:
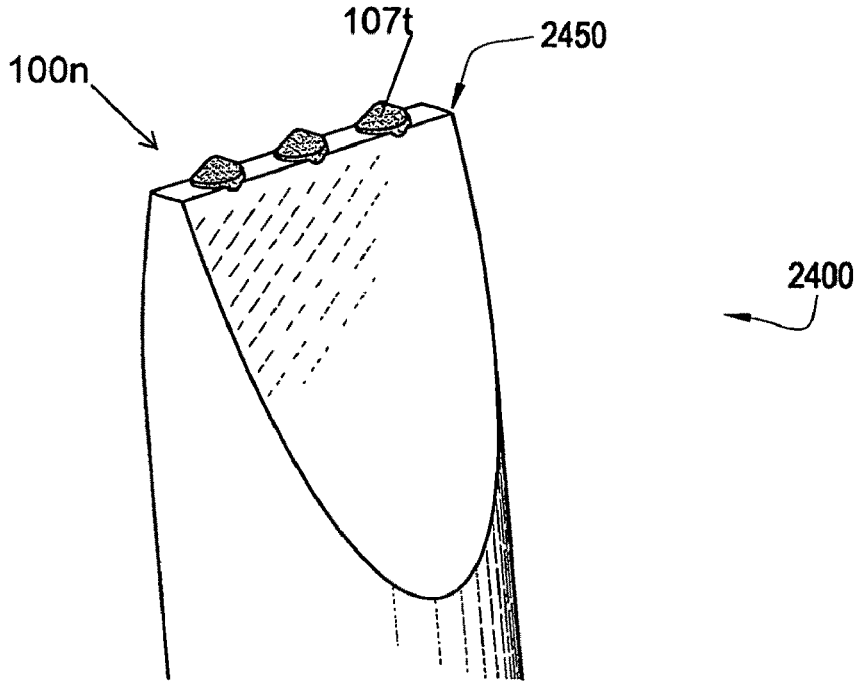
FIG. 24 is an isometric diagram of an embodiment of a chisel.
Figure 25:
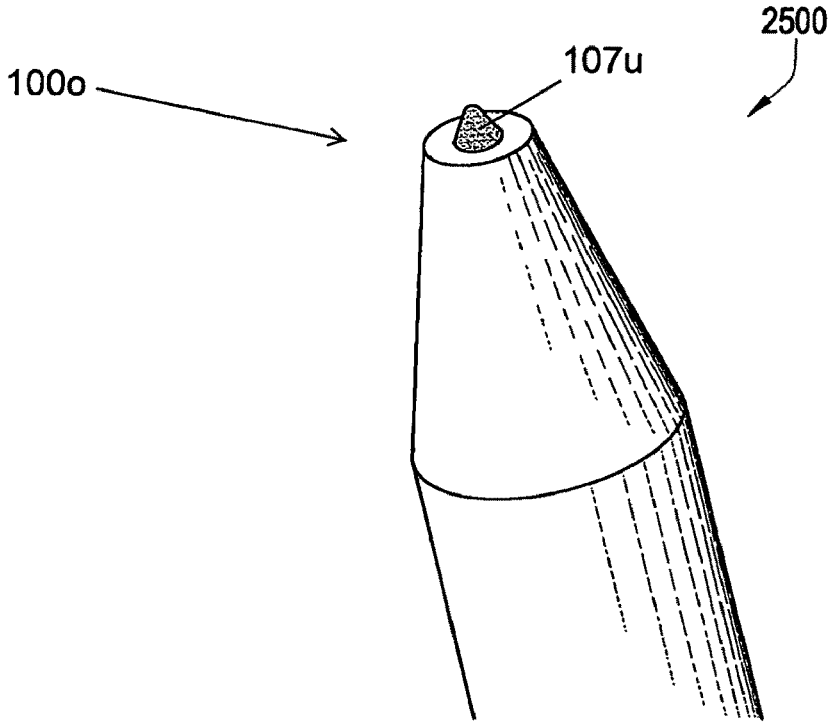
FIG. 25 is an isometric diagram of another embodiment of a moil.

FIGS. 24 and 25 illustrates a chisel 2400 or rock breaker that may also incorporate the present invention. At least one high impact resistant tool 100*n* with a tip 107*t* may be placed on the impacting end 2450 of a rock breaker with a chisel 2400.

FIG. 25 illustrates a moil 2500 that includes at least one high impact resistant tool 100*o* with a tip 107*u*. In some embodiments, the sides of the pointed geometry of the tip 107*u* may be flatted.

Figure 26:
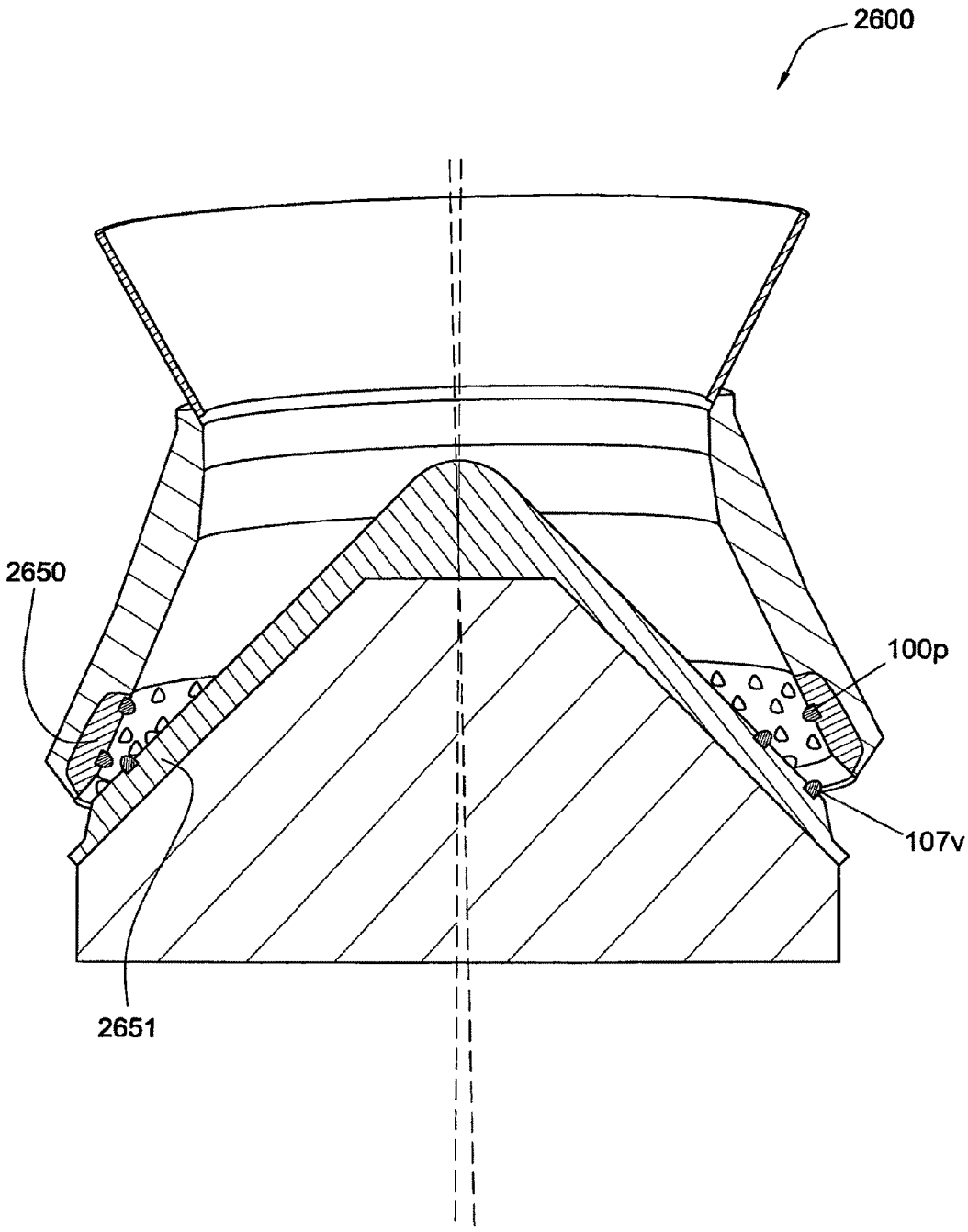
FIG. 26 is a cross-sectional diagram of an embodiment of a cone crusher.

FIG. 26 illustrates a cone crusher 2600, which may also incorporate embodiments of high impact resistant tools 100*p* and tips 107*v* that include a pointed geometry of superhard material. The cone crusher 2600 may comprise a top wear plate 2650 and a bottom wear plate 2651 that may incorporate the present invention.

Other applications not shown, but that may also incorporate the present invention, include rolling mills; cleats; studded tires; ice climbing equipment; mulchers; jackbits; farming and snow plows; teeth in track hoes, back hoes, excavators, shovels; tracks, armor piercing ammunition; missiles; torpedoes; swinging picks; axes; jack hammers; cement drill bits; milling bits; drag bits; reamers; nose cones; and rockets.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising a sintered polycrystalline diamond material bonded to a cemented metal carbide substrate at a non-planar interface, the substrate including a 5 to 10 percent concentration of cobalt by weight;

the diamond material comprises a substantially pointed geometry with an apex comprising 0.050 to 0.125 inch radius of curvature; and the diamond material comprises a 0.100 to 0.500 inch thickness from the apex to the non-planar interface;

the tool further comprises a central axis which intersects the interface between the diamond material and substrate;

wherein the tool comprises the characteristic of withstanding an impact of 130 joules.

2. The tool of claim 1, wherein the substantially pointed surface comprises a side which forms a 35 to 55 degree angle with a central axis of the tool.

3. The tool of claim 2, wherein the angle is substantially 45 degrees.

4. The tool of claim 1, wherein the substantially pointed geometry is selected from a group comprising a convex side and a concave side.

5. The tool of claim 1, wherein at the interface the substrate comprises a tapered surface starting from a cylindrical rim of the substrate and ending at an elevated flatted central region formed in the substrate.

6. The tool of claim 5, wherein the flatted region comprises a diameter of 0.125 to 0.250 inches.

7. The tool of claim 5, wherein the tapered surface is selected from a group comprising a concave surface and a convex surface.

8. The tool of claim 5, wherein the tapered surface incorporates nodules, grooves, dimples, protrusions, reverse dimples, or combinations thereof.

9. The tool of claim 1, wherein the radius is 0.090 to 0.110 inches.

10. The tool of claim 1, wherein the thickness from the apex to the nonplanar interface is 0.125 to 0.275 inches.

11. The tool of claim 1, wherein the diamond material and the substrate comprise a total thickness of 0.200 to 0.700 inches from the apex to a base of the substrate.

12. The tool of claim 1, wherein the sintered polycrystalline diamond material is synthetic diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, metal catalyzed diamond, or combinations thereof.

13. The tool of claim 1, wherein a volume of the diamond material is 75 to 150 percent of a volume of the carbide substrate.

14. The tool of claim 1, wherein the diamond material is polished.

15. The tool of claim 1, wherein the high impact tool is incorporated in drill bits, percussion drill bits, roller cone bits, shear bits, milling machines, indenters, mining picks, asphalt picks, cone crushers, vertical impact mills, hammer mills, jaw crushers, asphalt bits, chisels, trenching machines, or combinations thereof.

16. The tool of claim 1, wherein the substrate is bonded to an end of a carbide segment.

17. The tool of claim 15, wherein the carbide segment is brazed or press fit to a steel body.

18. The tool of claim 1, wherein the diamond material is a polycrystalline structure with an average grain size of 1 to 100 microns.

19. The tool of claim 1, wherein the diamond material comprises a 1 to 5 percent concentration of binding agents by weight.

20. The tool of claim 1, wherein the central axis also substantially intersects the apex of the diamond material.

21. A high impact resistant tool, comprising a sintered polycrystalline diamond material bonded to a cemented metal carbide substrate at an interface, said diamond material including:

an apex having a central axis, said central axis passing through said cemented metal carbide substrate, said apex having a radius of curvature measured in a vertical orientation from said central axis, said radius of curvature being from about 0.050 to 0.125 inches; and a 0.100 to 0.500 inch thickness from said apex to said interface.

* * * * *